US009053667B2

(12) United States Patent
Katsuse et al.

(10) Patent No.: US 9,053,667 B2
(45) Date of Patent: Jun. 9, 2015

(54) ELECTRO-OPTIC DEVICE AND DRIVING METHOD OF ELECTRO-OPTIC DEVICE HAVING AN ASYMMETRICAL PIXEL STRUCTURE

(71) Applicants: Hirofumi Katsuse, Yokohama (JP); Takeshi Okuno, Yokohama (JP); Ryo Ishii, Yokohama (JP); Naoaki Komiya, Yokohama (JP)

(72) Inventors: Hirofumi Katsuse, Yokohama (JP); Takeshi Okuno, Yokohama (JP); Ryo Ishii, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 265 days.

(21) Appl. No.: 13/653,628

(22) Filed: Oct. 17, 2012

(65) Prior Publication Data

US 2013/0093736 A1 Apr. 18, 2013

(30) Foreign Application Priority Data

Oct. 17, 2011 (JP) ..... 2011-227597

(51) Int. Cl.

*G09G 3/30* (2006.01)
*G09G 3/32* (2006.01)
*G09G 3/10* (2006.01)

(52) U.S. Cl.

CPC ..... *G09G 3/3233* (2013.01); *G09G 3/3225* (2013.01); *G09G 2300/0842* (2013.01); *G09G 2300/0861* (2013.01)

(58) Field of Classification Search

CPC ..... G09G 3/3225
USPC ..... 345/76
See application file for complete search history.

(56) References Cited

U.S. PATENT DOCUMENTS

2003/0146712 A1* 8/2003 Inukai ..... 315/169.3
2005/0259703 A1* 11/2005 You et al. ..... 372/38.07
2005/0285826 A1* 12/2005 Park et al. ..... 345/76
2006/0152450 A1* 7/2006 Giraldo et al. ..... 345/76

(Continued)

FOREIGN PATENT DOCUMENTS

JP 2010-250111 A 11/2010
JP 2011-034039 A 2/2011

(Continued)

OTHER PUBLICATIONS

In, et al., Emission and Programming Time Extension Method for Active Glass Type Stereoscopic 3-Dimensional AMOLED Displays, Dept. of Electronic Engineering, Hanyang University, May 2011.

(Continued)

*Primary Examiner* — Adam J Snyder
(74) *Attorney, Agent, or Firm* — Lee & Morse, P.C.

(57) ABSTRACT

The electro-optic device includes a plurality of data lines, a plurality of scan lines, a plurality of pixel areas arranged at crossings of the data lines and the scan lines, and light emitting elements, wherein first pixel areas are in alternating columns, each first pixel area including only one pixel circuit configured to cause the light emitting elements to emit light, wherein second pixel areas are in alternating columns between the first pixel areas, each second pixel area including two pixel circuits configured to cause the light emitting elements to emit light, and wherein a writing process is performed on the second pixel areas to cause light emitting elements on the pixel circuits on one side to emit light in a period for causing light emitting elements on the pixel circuits on the other side to emit light.

15 Claims, 9 Drawing Sheets

(56) References Cited

U.S. PATENT DOCUMENTS

| | | | | |
|---|---|---|---|---|
| 2006/0221004 | A1* | 10/2006 | You et al. | 345/76 |
| 2007/0035483 | A1* | 2/2007 | Chang | 345/76 |
| 2007/0075937 | A1* | 4/2007 | Kim | 345/76 |
| 2008/0136750 | A1* | 6/2008 | Benzarti | 345/76 |
| 2008/0231556 | A1* | 9/2008 | Kretz et al. | 345/76 |
| 2010/0141646 | A1* | 6/2010 | Tanabe | 345/76 |
| 2011/0057919 | A1* | 3/2011 | Kim et al. | 345/82 |
| 2011/0279422 | A1* | 11/2011 | Byun | 345/76 |

FOREIGN PATENT DOCUMENTS

| | | | |
|---|---|---|---|
| KR | 10-2010-0070857 | A | 6/2010 |
| KR | 10-2011-0136775 | A | 12/2012 |

OTHER PUBLICATIONS

Park, et al. P-166: Successive Cross Emission Driving for 3-Dimensional Active-Matrix Organic Light Emitting Diode Displays, SID Digest, 2011.

* cited by examiner

ELECTRO-OPTIC DEVICE AND DRIVING METHOD OF ELECTRO-OPTIC DEVICE HAVING AN ASYMMETRICAL PIXEL STRUCTURE

CROSS-REFERENCE TO RELATED APPLICATION

This application claims under 35 U.S.C. §119 priority to and the benefit of Japan Patent Application No. 2011-227597, filed in the Japan Intellectual Property Office on Oct. 17, 2011, the entire contents of which are incorporated herein by reference.

BACKGROUND

1. Field

Example embodiments relate to an electro-optic device and a driving method of an electro-optic device.

2. Description of the Related Art

In general, a liquid crystal display having a transmissive or semi-transmissive reflective liquid crystal panel or an organic EL display having an organic EL display panel including an organic EL element panel is widely used as a display of a television set. Such a display has a demand for fast driving of a pixel circuit in line with the recent trend of higher resolution and three-dimensional image display.

In order to allow an image displayed by a display device to be perceived by a user, a shutter glass including a polarization element, such as liquid crystal, may be used. The shutter glass opens and closes the shutter in synchronization with a timing at which an AMOLED panel changes and displays an image for the left and right eyes during 1 frame (60 Hz), and presents a displayed image only to the appropriate eye.

If the panel is made to emit light in a period in which the opening and closing of the shutters are not complete, two left and right images appear to be mixed. Due to this, the panel is in an off mode in which no image is displayed, during the period in which the opening and closing of the shutters are not complete, and all the pixels of the panel simultaneously emit light after one of the shutters is opened. Accordingly, it is possible to attain display quality without the so-called "3D crosstalk" by which the left-eye and right-eye images do not appear to be mixed at all.

For example, a first conventional electro-optic device may include a light emitting element and a pixel circuit having a pixel voltage sustaining and current control circuit in the pixel area of a pixel. The pixel may be installed at a crossing point of a scan line and a data signal line. The light emitting element is an element which self-emits light depending on an amount of current when current flows.

When LOW voltage is applied to the scan line, a pixel circuit including a PMOSFET is synchronized with the timing at which a pixel switch is turned on, and a capacitor is updated as it is charged with a pixel voltage based on image data from the data signal line. Afterwards, when HIGH voltage is applied to the scan line, the pixel switch is turned OFF and the pixel voltage is maintained. After completing the update of data of all the pixels, when a light emitting switch is turned on by applying LOW voltage to a light emission control line of all the pixels simultaneously, the light emitting element emits light by a current flowing from an anode power line to a cathode power line.

To eliminate the above-mentioned 3D crosstalk, the first conventional electro-optic device rewrites the previous pixel voltage of the panel by conducting linear sequential scanning based on left-eye image data during the non-emission period corresponding to a half period, and causes the pixels to emit light and display the left-eye image after completion of the rewriting of the previous pixel voltage. A pixel voltage based on image data is charged in the data signal line while a predetermined signal is being applied to the scan line sequentially, starting from the first row, and the light emitting switch is turned on by a control signal for turning the light emitting switch on, thereby causing the screen to emit light.

Likewise, the first conventional electro-optic device rewrites a previous pixel voltage on the panel by conducting linear sequential scanning based on right-eye image data during the non-emission period of the next subframe, and causes the pixels to emit light and display the left-eye image after completion of the rewriting of the previous pixel voltage.

In the above example, the previous pixel is updated in a period of nearly a quarter of 1 frame. However, if the screen has higher resolution and larger size, it may be difficult to ensure a sufficient period for updating each pixel with display data.

In another example, a second conventional electro-optic device may include a light emitting element and two pixel circuits having a pixel voltage sustaining and current control circuit in the pixel area of a pixel. The pixel may be surrounded by scan lines, a data signal, and an anode power line at a crossing point of a scan line and a data signal line. The second conventional electro-optic device can sustain left and right pixel voltages, respectively, by means of the two pixel circuits within one pixel.

A display data of a right-eye image can be written on the pixel circuit during the emission and display period of a left-eye image kept at the pixel voltage of the pixel circuit. More specifically, in the second conventional electro-optic device, the pixel voltage is updated by linear sequential driving based on the image data of the current frame, after completion of the emission period of the previous frame. The pixel voltage can be updated based on the image data of the current frame, starting from a second emission period of the previous frame, and a period of time lasting until the completion of a first non-emission period can be allocated to a display data update period.

A period of time consumed only for an emission operation in the electro-optic device is added to the existing data update period during non-emission of the second conventional electro-optic device. Accordingly, the total data update period of the second conventional electro-optic device is substantially twice that of the first electro-optic device. The second electro-optic device can have a significant effect against a lack of the data update period. However, the second conventional electro-optic device having a plurality of pixel circuits installed for each pixel has the problem of low productivity because of a significant increase in the number of circuit elements per pixel, and a bottom emission type AMOLED having no pixel circuit and configured to transmit light from an aperture has the problem of low aperture ratio.

SUMMARY

Example embodiments have been made in an effort to provide a novel and improved electro-optic device, which secures a sufficient period for charging each pixel and suppresses a decrease in aperture ratio even if the screen has higher resolution and larger size, and a driving method of the same.

An exemplary embodiment provides an electro-optic device which includes a plurality of pixel areas at intersections of a plurality of data lines and scan lines, and a plurality of light emitting elements, the light emitting elements being configured to emit light for a predetermined period of time in all the pixel areas during an emission period of a frame and configured not to emit light during a non-emission period of the frame, wherein first pixel areas are in alternating columns, each first pixel area including only one pixel circuit configured to cause the light emitting elements to emit light, wherein second pixel areas are in alternating columns between the first pixel areas, each second pixel area including two pixel circuits configured to cause the light emitting elements to emit light, and wherein a writing process is performed on the second pixel areas to cause light emitting elements on the pixel circuits on one side to emit light in a period for causing light emitting elements on the pixel circuits on the other side to emit light.

The pixel circuits on one side of each of the pixel areas each including two pixel circuits may be physically divided.

The divided pixel circuits may be positioned at some part of the pixel areas each including only one pixel circuit.

The emission period and the non-emission period may be repeated twice in 1 frame.

The emission period and the non-emission period may have the same length or different lengths.

Another embodiment provides a driving method of an electro-optic device which includes a plurality of data lines, a plurality of scan lines, and a plurality of pixel areas arranged at crossings of the data lines and the scan lines and including light emitting elements, in which a frame includes an emission period in which the light emitting elements emit light in all the pixel areas for a predetermined period of time and a non-emission period in which the light emitting elements do not emit light, and in which pixel areas each including only one pixel circuit for causing the light emitting elements to emit light are installed ever other line, and pixel areas each including two pixel circuits for causing the light emitting elements to emit light are installed every other line in rows between the pixel areas each including one pixel circuit, wherein the method includes: the first step in which the light emitting elements supplying no current to the light emitting elements perform a writing process on the pixel areas each including two pixel circuits to cause the light emitting elements to emit light in the emission period in which the light emitting elements emit light; and the second step in which the pixel circuits perform a writing process on the pixel areas each including one pixel circuit to cause the light emitting elements to emit light in the non-emission period in which the light emitting elements do not emit light.

The emission period and the non-emission period may be repeated twice in 1 frame.

The emission period and the non-emission period may have the same length or different lengths.

If the emission period is longer than the non-emission period, the first step may be performed only during the non-emission period.

As described above, according to the example embodiments, an improved electro-optic device and a driving method thereof can be provided, which secures a sufficient period for charging each pixel and suppresses a decrease in aperture ratio even if the screen has higher resolution and larger size.

DETAILED DESCRIPTION

Figure 1:
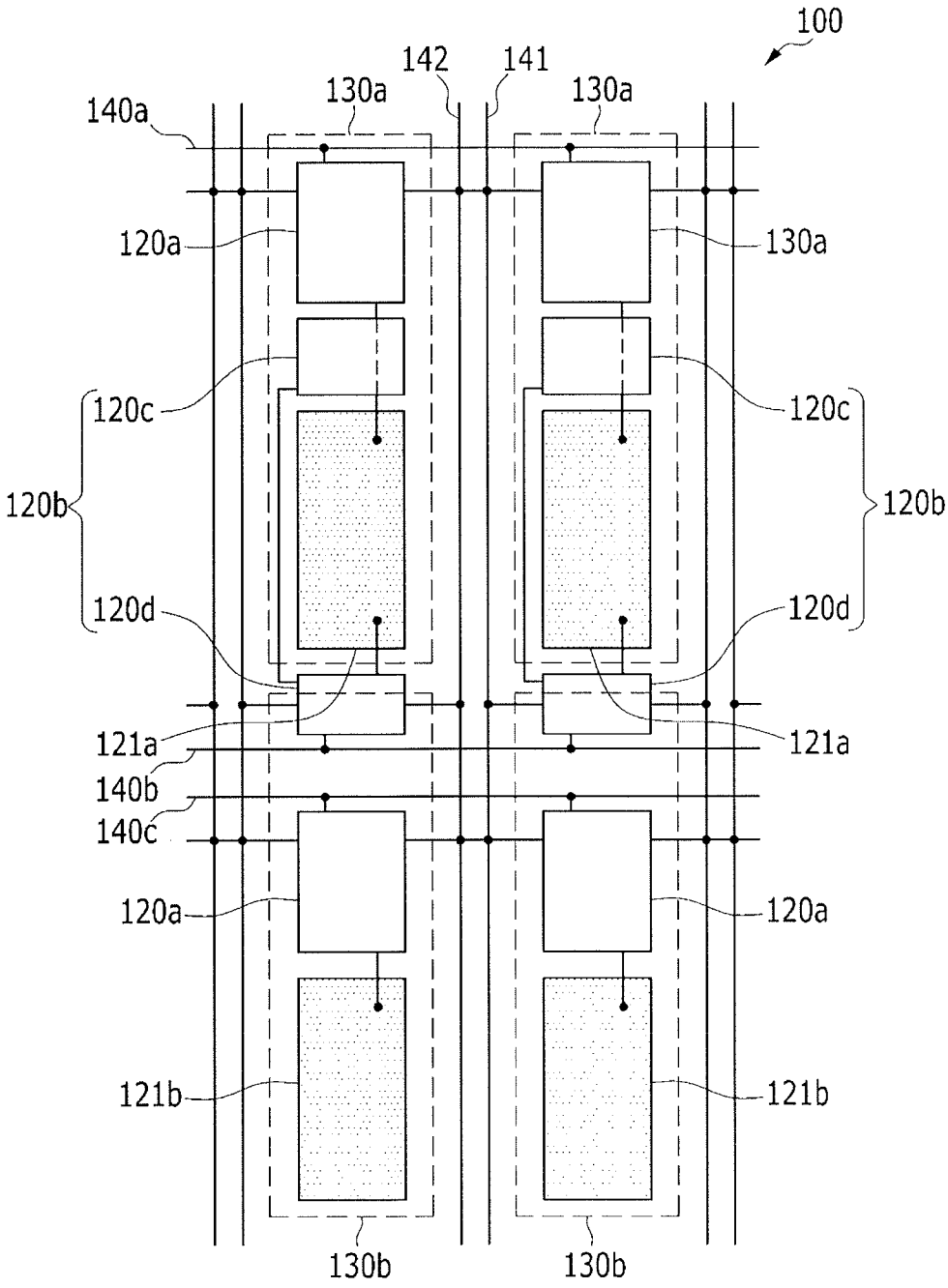
FIG. 1 is a view showing the configuration of an electro-optic device according to an exemplary embodiment.

Hereinafter, an exemplary embodiment will be described in detail with reference to the accompanying drawings. Also, in the specification and drawings, components having substantially the same functions are denoted by the same reference numerals, and a repeated explanation thereof will not be given.

First, an example of the configuration of an electro-optic device according to an exemplary embodiment will be described with reference to the drawings.

FIG. 1 is a view showing the configuration of an electro-optic device 100 according to an exemplary embodiment.

As shown in FIG. 1, the electro-optic device 100 according to an exemplary embodiment includes scan lines 140*a*, 140*b*, and 140*c*, a data signal line 141, an anode power line 142, and pixels 130*a* and 130*b* indicated by broken lines and arranged alternately every other line. The pixels 130*a* and 130*b* each include a pixel circuit 120*a* and a light emitting element 121*a* and 121*b*.

The light emitting element 121*a* and 121*b* is an element which self-emits light depending on amount of current when current flows. The pixel circuit 120*a* includes a pixel voltage sustaining and current control circuit for causing the light emitting element 121*a* to emit light. The pixel circuit 120*b*, as well as the pixel circuit 120*a*, is connected to the light emitting element 121*a* provided for each pixel 130*a*. The pixel circuit 120*b* consists of pixel circuits 120*c* and 120*d*, and the pixel circuits 120*c* and 120*d* are formed by dividing the pixel circuit 120*b* in two. The pixel circuit 120*c* is included in the pixel 130, and the pixel circuit 120*d* extends across the pixel 130*b*. The pixel circuits 120*c* and 120*d* constituting the pixel circuit 120*b* are divided, e.g., separated, from each other so that the light emitting element 121*a* is disposed at equal intervals at upper and lower pixels 130.

Accordingly, the pixel circuit 120*a* and the pixel circuit 120*b* have the same function as an electrical circuit, and the positional relationship between a light emitting element and a pixel circuit is not limited to the above-mentioned example. In any case, the pixel circuit 120*a* and the pixel circuit 120*b* are connected to the light emitting element 121*a*, and each can update and maintain the pixel voltage independently. The pixel circuit 120*a* included in the pixel 130*b* is connected only to the light emitting element 121*b*.

Although FIG. 1 describes only the scan lines 140*a*, 140*b*, and 140*c* for simplicity, a control line for independently controlling the pixel circuits 120*a* and 120*b* is added to the electro-optic device 100 according to an exemplary embodiment, as described below.

Figure 2:
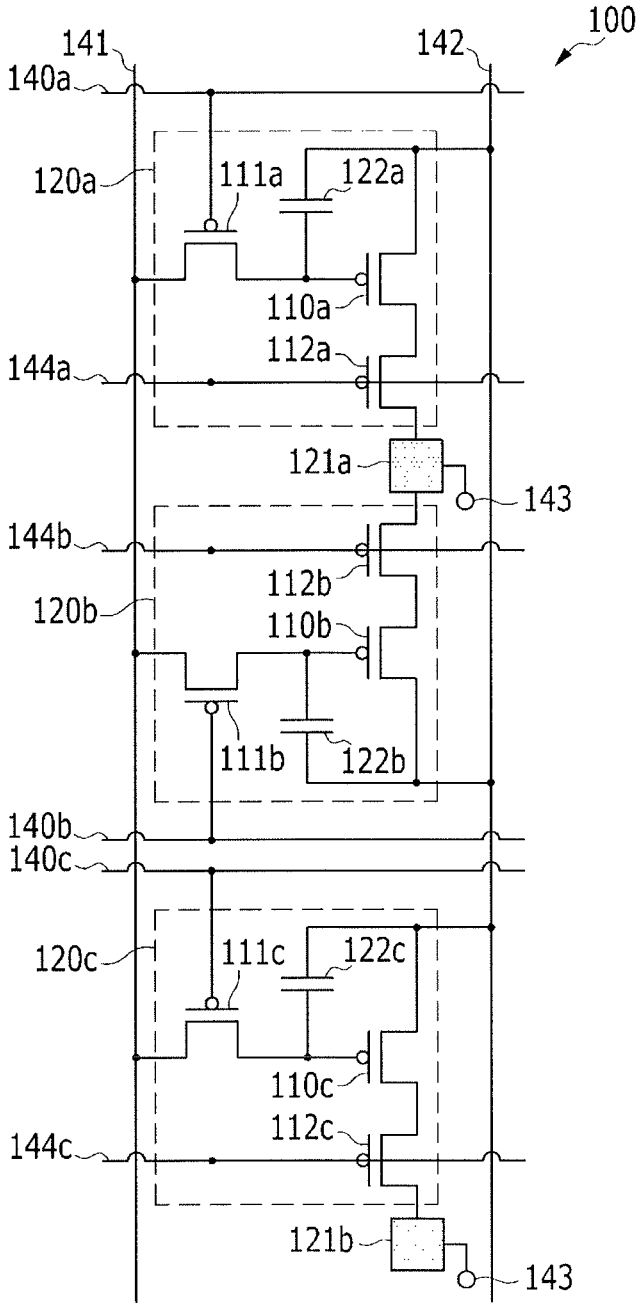
FIG. 2 is a view showing an example of the specific circuit configuration of pixels of the electro-optic device according to an exemplary embodiment.

FIG. 2 is a view showing an example of the specific circuit configuration of pixels 130*a* and 130*b* of the electro-optic device 100 according to an exemplary embodiment. FIG. 2 illustrates light emission control lines 144*a*, 144*b*, and 144*c* for independently controlling the pixel circuits 120*a* and 120*b*.

As shown in FIG. 2, when LOW voltage is applied to the scan lines 140*a*, 140*b*, and 140*c*, a pixel circuit including a PMOSFET is synchronized with the timing at which pixel switches 111*a*, 111*b*, and 111*c* each are turned on, and capacitors 122*a*, 122*b*, and 122*c* are refreshed as they are charged with a pixel voltage based on image data from the data signal line 141. Afterwards, when HIGH voltage is applied to the scan lines 140*a*, 140*b*, and 140*c*, the pixel switches 111*a*, 111*b*, and 111*c* are turned OFF and the pixel voltage is maintained. After completing the update of data of all the pixels, when light emission switches 112*a*, 112*b*, and 112*c* are turned on by applying LOW voltage to the light emission control lines of all the previous pixels simultaneously, the light emitting elements 121*a*, 121*b*, and 121*c* emit light by a current flowing from an anode power line 142 to a cathode power line 143.

The pixel circuits 120*a* and 120*b* are driven independently, and the turn on/off of the light emission switches 112*a* and 112*b* is controlled independently. In other words, when a pixel voltage is charged in the pixel circuit 120*a*, the light emission switch 112*a* is turned on in an emission period, and when a pixel voltage is charged in the pixel circuit 120*b*, the light emitting switch 112*b* is turned on in an emission period.

As the pixel circuits 120*a* and 120*b* are thusly driven independently, the electro-optic device 100 according to an exemplary embodiment can update display data and secure an update time of the display data by charging a pixel voltage in the pixel circuit on one side while causing the light emitting element 130*a* to emit light with the pixel voltage maintained by the pixel circuit on the other side.

The pixel circuit 120*b* is divided into two pixel circuits 120*c* and 120*d*, as shown in FIG. 1, and may be divided into a capacitor 122*b* having a large circuit area and another element.

Figure 3:
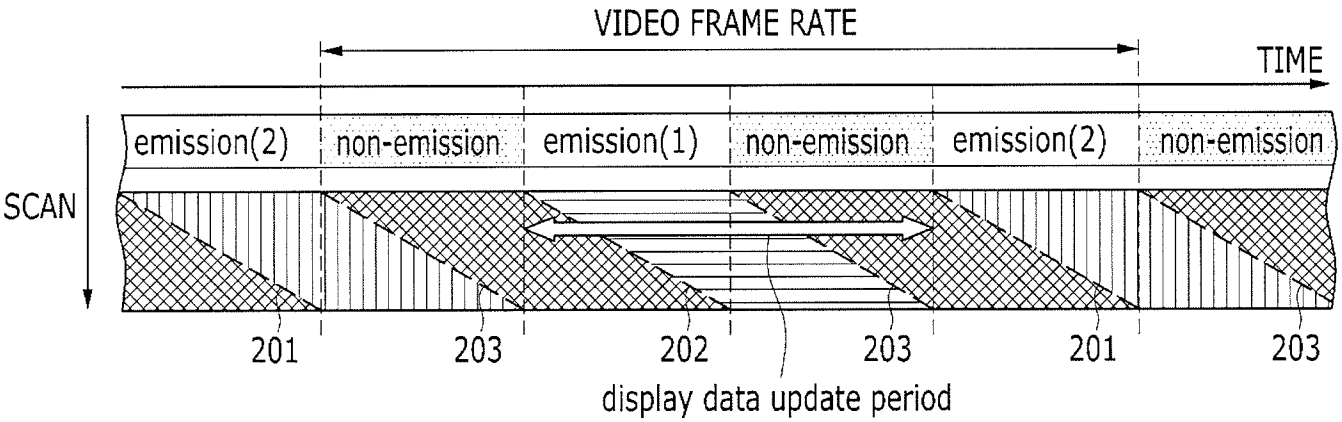
FIG. 3 is a view showing the panel driving timing of the electro-optic device according to an exemplary embodiment.
Figure 4:
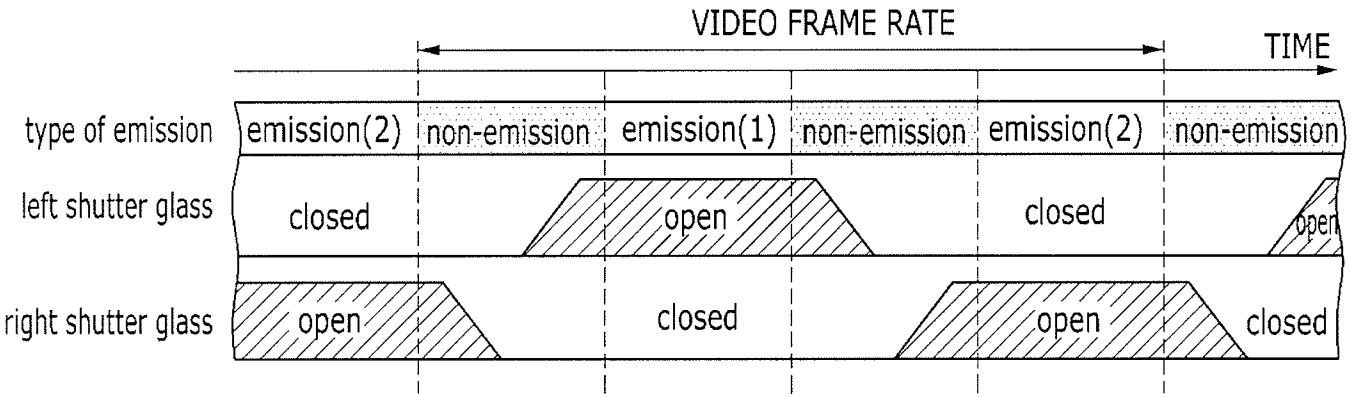
FIG. 4 is a view showing the driving of shutter glass when a three-dimensional image is displayed by the electro-optic device according to an exemplary embodiment.

FIG. 3 is a view showing the panel driving timing of the electro-optic device 100 according to an exemplary embodiment. FIG. 4 is a view showing the driving of shutter glass when a three-dimensional image is displayed by the electro-optic device 100 according to an exemplary embodiment.

In the electro-optic device 100 shown in FIG. 1, the pixel voltage of the panel is updated such that the left and right images alternate every subframe period of 120 Hz, as shown in FIG. 3.

To eliminate the above-mentioned 3D crosstalk, the electro-optic device 100 rewrites the previous pixel voltage of the panel by conducting linear sequential scanning based on left-eye image data during the a half period of non-emission period, and causes the pixels to emit light and display the left-eye image after completion of the rewriting of the previous pixel voltage, as shown in FIG. 3. The broken lines indicated by reference numerals 201, 202, and 203 schematically indicate the state of linear sequential scanning.

Reference numeral 201 indicates the state of linear sequential scanning of the pixel circuit 120*a* of the pixel 130*a*, reference numeral 202 indicates the state of linear sequential scanning of the pixel circuit 120*b* of the pixel 130*a*, and reference numeral 203 indicates the state of linear sequential scanning of the pixel circuit 120*a* of the pixel 130*b*. For example, light emission 1 indicates a display period of the left-eye image, and light emission 2 indicates a display period of the right-eye image.

Each pixel in which display data is written by the linear sequential scanning indicated by reference numerals 201 and 203 emits light in a subsequent period of light emission 1. Each pixel in which display data is written by the linear sequential scanning indicated by reference numerals 202 and 203 emits light in a subsequent period of light emission 2.

'Display data update period' shown in the timing chart of FIG. 3 is an update period of display data of either one of the pixel circuit 120*a* and the pixel circuit 120*b* included in the pixel 130*a* or an update period of display data of the pixel circuit 120*a* included in the pixel 130*b*. For example, display data of the pixel circuit 120*a* cannot be updated while the pixel circuit 120*a* maintains the pixel voltage.

This is because the displayed image is shattered. In this case, the pixel voltage is maintained in the pixel circuit 120*a*, and the display data of the pixel circuit 120*b* is updated.

In the period of light emission 2, when LOW voltage is applied to the scan line 140, the pixel circuit 120*a* of the pixel 130*a* is synchronized with the timing at which the pixel switch 111 is turned on, and the capacitor 122*a* is refreshed as it is charged with a pixel voltage based on left-eye image data from the data signal line 141. Then, when HIGH voltage is applied to the scan line 140*a*, the pixel switch 111*a* is turned OFF and the pixel voltage is maintained. Since the scan line 140*a* is installed horizontally in every two pixels, i.e., next to every other pixel, it is scanned every other line, e.g., every other odd-numbered line, and half of the previous pixel is updated.

In a period of light emission 2, LOW voltage is applied to the light emission control lines 144*b* and 144*c* to turn the light emission switches 112*b* and 112*c* on, thereby controlling the driving of the light emission devices 121*a* and 121.

In the previous frame, the display data of the pixel circuit 120*b* of the pixel 130*a* is updated in the following order.

At least immediately after applying power to the panel, the previous pixel data is updated to a pixel voltage of black display when the light emission control switch is turned OFF. Continuously, at the completion timing of the period of light emission 2, i.e., in the first non-emission period of the current frame, the pixel circuit 120*a* of the pixel 130*b* starts to update the pixel voltage based on the left-eye image data of the current frame. In the same manner as the scan line 140*a*, the scan line 140*c* is scanned every other line, e.g., every other even-numbered line, and half of the previous pixel is updated under the same control.

In the first non-emission period, HIGH voltage is applied to all the light emission control lines 144*a*, 144*b*, and 144*c* to turn the light emission switches 112*a*, 112*b*, and 112*c* off. LOW voltage is applied to the light emission control lines 144*a* and 144*c* at the timing at which all the pixel voltages of the pixel circuits 120*a* of the pixels 130*b* are updated, and the driving of the respective connected light emitting elements 121*a* and 121*b* are controlled by the maintained voltage of the pixel circuit 120*a* of the pixel 130*a* and of the pixel circuit 120*a* of the pixel 130*b*, whereby the period of light emission 1 based on the left-eye image data is initiated.

During the period of light emission 1, the pixel circuit 120*b* of the pixel 130*a* starts to update the pixel voltage based on the right-eye image data of the current frame. At this point, the scan line 140*b* is scanned every other line, and half of the previous pixel is updated.

In the second non-emission period during which the period of light emission 1 (the update of the pixel circuit 120*b* of the pixel 130*a*) is completed, the pixel circuit 130*a* of the pixel

130*b* is likewise scanned every other line and the remaining half of the previous pixel is updated. Afterwards, LOW voltage is applied to the light emission control lines 144*b* and 144*c*, and the driving of the respective connected light emitting elements 121*a* and 121*b* are controlled by the maintained voltage of the pixel circuit 120*a* of the pixel 130*a* and of the pixel circuit 120*a* of the pixel 130*b*, whereby the period of light emission 2 based on the right-eye image data is initiated.

Hereinafter, the displaying of the left-eye and right-eye images is realized by sequentially repeating this control. As shown in FIG. 3, the display data update period may be substantially twice that of the conventional art.

Figure 5:
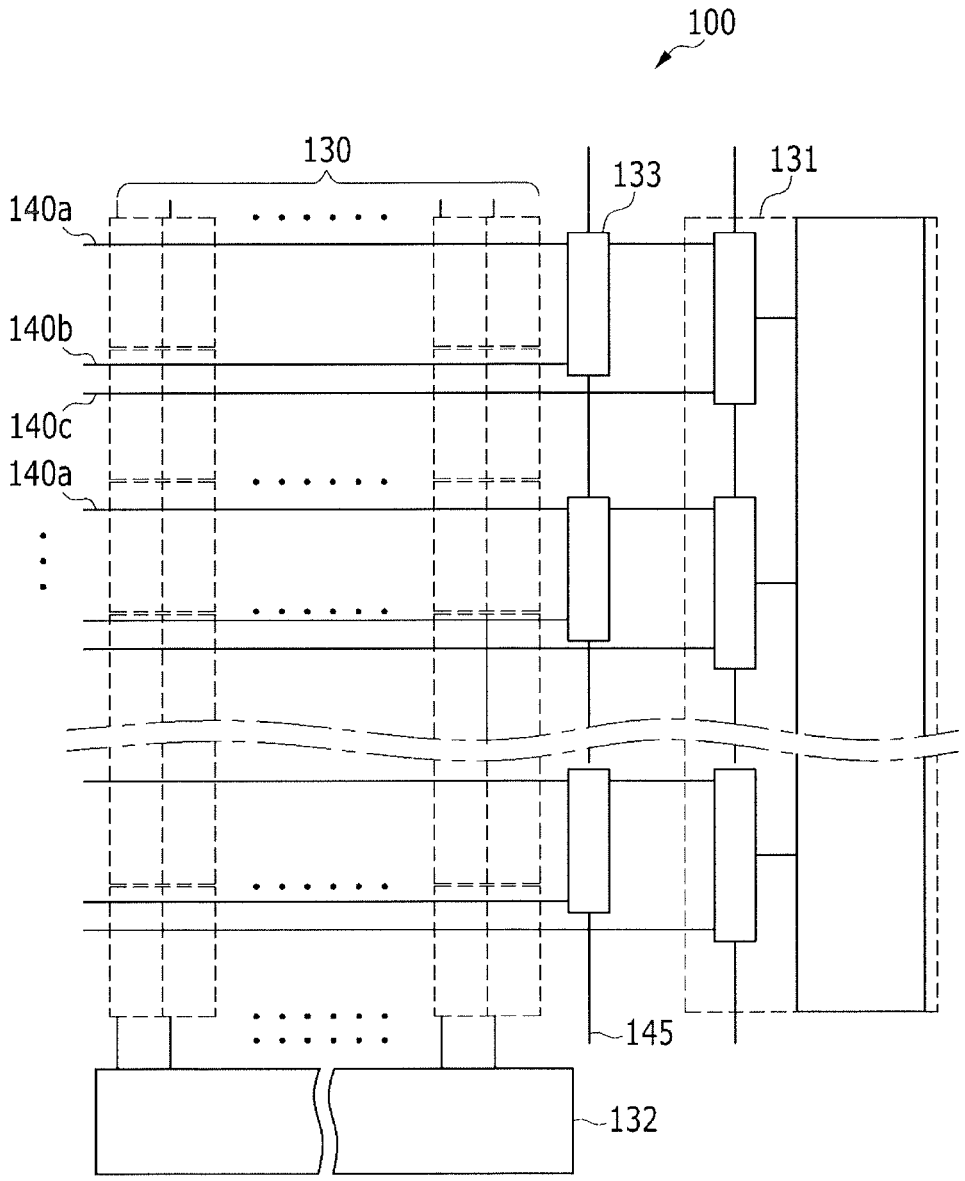
FIG. 5 is a view showing a circuit block incorporating a panel, which is included in the electro-optic device according to an exemplary embodiment.

FIG. 5 is a view showing a circuit block incorporating a panel, including pixels 130 (pixels 130*a* and 130*b*) in a matrix array, scan control circuits 131, and data signal control circuits 132, which is included in the electro-optic device 100 according to an exemplary embodiment. As shown in FIG. 5, a control circuit 133 may be installed behind the scan control circuit 131 to change the output destination every subframe when the output of the scan control circuit 131 is switched every 120 Hz. Thus, a signal output from the scan control circuit 131 and input into the scan line 140*a* and 140*b* may be switched between the scan line 140*a* and the scan line 140*b*.

In FIG. 5, the purpose of a target pixel switching signal line LR 145 for controlling the control circuit 133 that changes the output destination every subframe is illustrated.

The electro-optic device 100 according to an exemplary embodiment performs scanning every other line. As a result, a shift register circuit within the scan control circuit 131 is reduced to half the size of that of the conventional art. The output destination is switched to the pixel 130*a* and the pixel 130*b* every ¼ frame, and the output destination is switched to the pixel circuit 120*a* and pixel circuit 120*b* of the pixel 130*a* every ½ frame.

Figure 6:
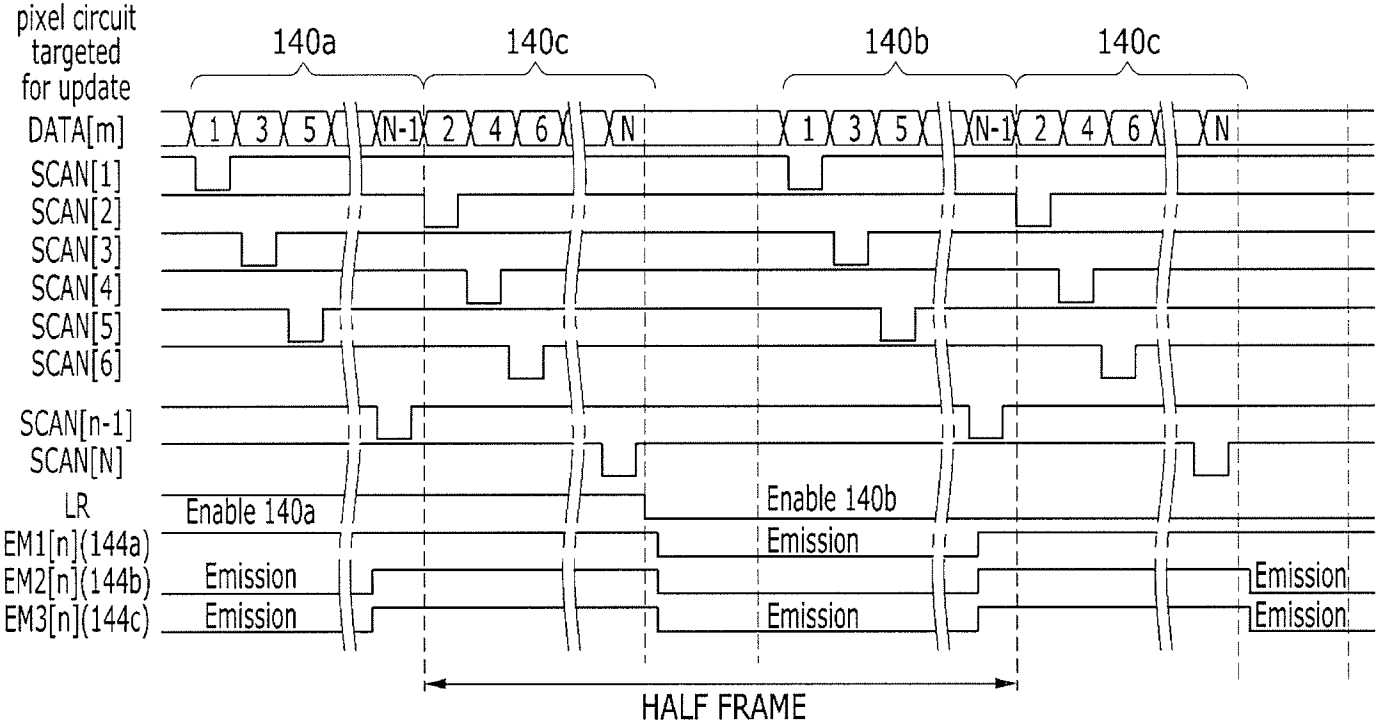
FIG. 6 is a view showing the timing chart of a control signal for a pixel circuit of the electro-optic device of FIG. 1 according to an exemplary embodiment.

FIG. 6 is a view showing the timing chart of a control signal for a pixel circuit of the electro-optic device 100 of FIG. 1 according to an exemplary embodiment.

The timing chart shown in FIG. 6 depicts DATA [m] applied to the data signal line 141, SCAN [1] applied to the scan line 140*a* or scan line 140*b* of a first row, SCAN [2] applied to the scan line 140*c* of a second row, . . . , SCAN [n−1] applied to the scan line 140 or scan line 140*b* of an (n−1)th row, SCAN [n] applied to the scan line 140*c* of an n-th row, a target pixel switching signal line LR applied to the target pixel switching signal line 145 which makes either the scan line 140*a* or the scan line 140*b* effective, and control signals EM1 [n], EM2 [n], EM3 [n] for turning the light emission switches 112*a*, 112*b*, and 112*c* on.

When the target pixel switching signal line LR is HIGH, the scan line 140*a* is selected, and when the target pixel switching signal line LR is LOW, the scan line 140*b* is selected.

When the target pixel switching signal line LR is HIGH, if SCAN [1], [2], . . . , [n−1], [n] become low sequentially, the scan line 140*a* and the scan line 140*c* are selected every other line. When the target pixel switching signal line LR is LOW, if SCAN [1], [2], . . . , [n−1], [n] become low sequentially, the scan line 140*b* and the scan line 140*c* are selected every other line. By applying a signal as shown in FIG. 6, the electro-optic device 100 according to an exemplary embodiment is capable of the above-described operation.

Figure 7:
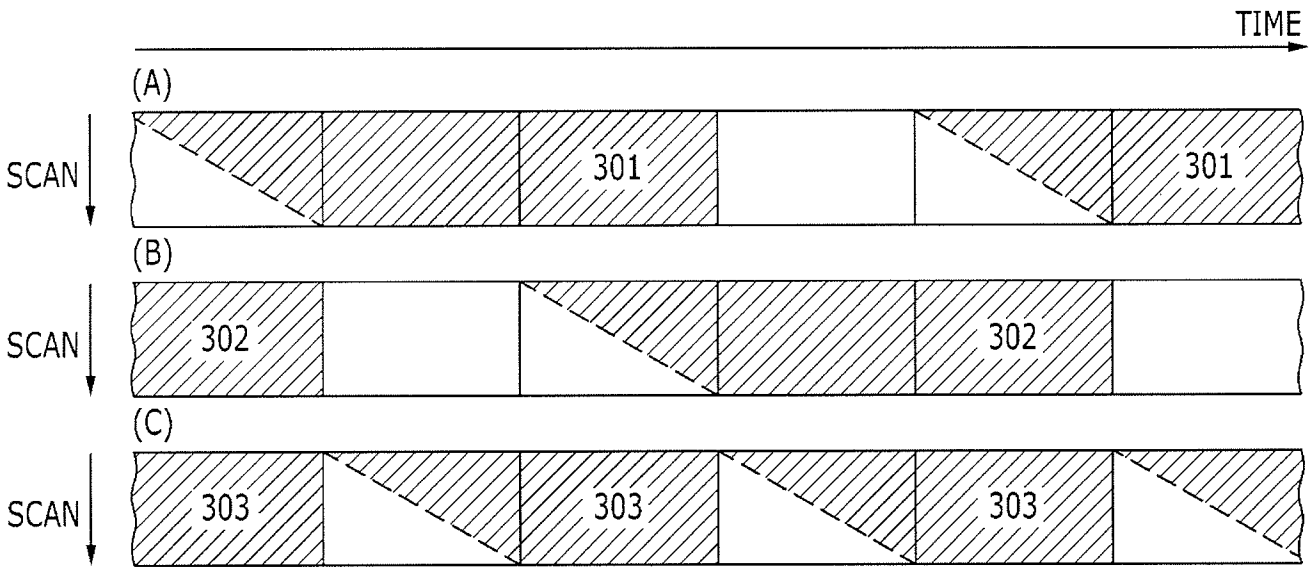
FIG. 7 is a view showing a required maintenance time of display data in the electro-optic device according to an exemplary embodiment.

FIG. 7 is a view showing a required maintenance time of display data in the electro-optic device 100 according to an exemplary embodiment. FIG. 7(*a*) depicts a required maintenance time of display data updated in a scan period 201 of FIG. 3, FIG. 7(*b*) depicts a required maintenance time of display data updated in a scan period 202 of FIG. 3, and FIG. 7(*c*) depicts a required maintenance time of display data updated in a scan period 201 of FIG. 3.

For better understanding of FIG. 7, periods during which the respective pixel circuits need to maintain the pixel voltage for display are indicated by oblique lines denoted by reference numerals 301, 302, and 303. As shown in FIG. 7, in the electro-optic device 100 according to an exemplary embodiment, the sustaining voltage that can be used for display every emission period alternates between the pixel circuit 120*a* and pixel circuit 120*b* of the pixel 130*a*.

As explained above, by linearly sequentially scanning half of the previous pixel in advance in an emission period to maintain the pixel voltage of the pixel circuits and linearly sequentially scanning the other pixels in a non-emission period to maintain the pixel voltage of the pixel circuits, the electro-optic device 100 according to an exemplary embodiment can secure a sufficient period for charging each pixel even if the screen has higher resolution and larger size. Further, the electro-optic device 100 according to an exemplary embodiment can ensure a higher aperture ratio and a sufficient brightness for image display, as compared to when two pixel circuits are provided for each pixel. That is, the electro-optic device 100 secures a sufficient period for charging each pixel and suppresses a decrease in aperture ratio even if the screen has higher resolution and larger size.

Figure 8:
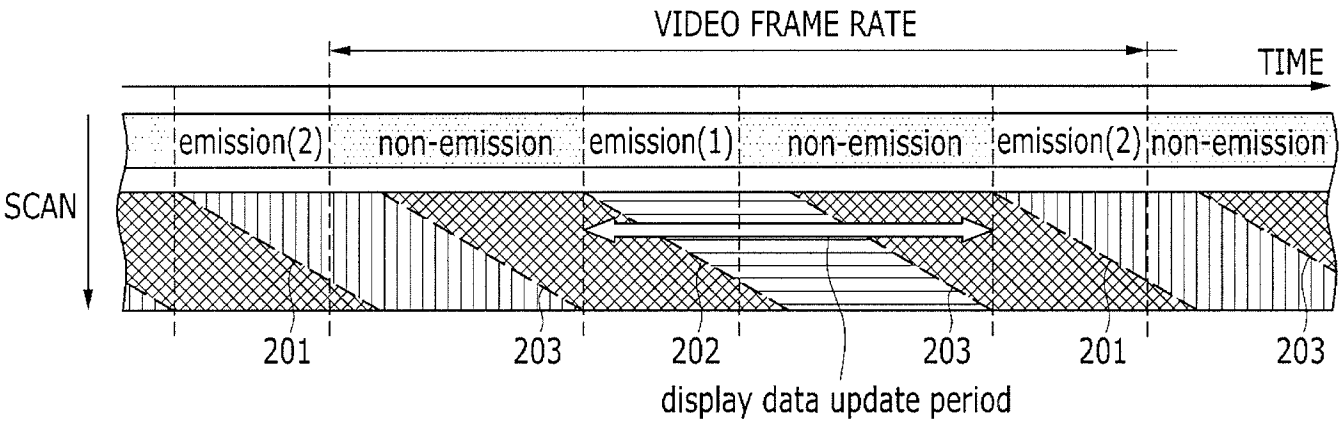
FIG. 8 is a view showing another example of the panel driving timing of the electro-optic device according to an exemplary embodiment.

FIG. 8 is a view showing another example of the panel driving timing of the electro-optic device 100 according to an exemplary embodiment. If a non-emission period and an emission period are of nearly the same length, a maximum data update period can be secured. For example, even if the non-emission period is longer than the emission period, as shown in FIG. 8, data written in the pixel 130*a* and the pixel 130*b* is allocated to half of the sum of both periods, thereby efficiently extending the data write time.

Figure 9:
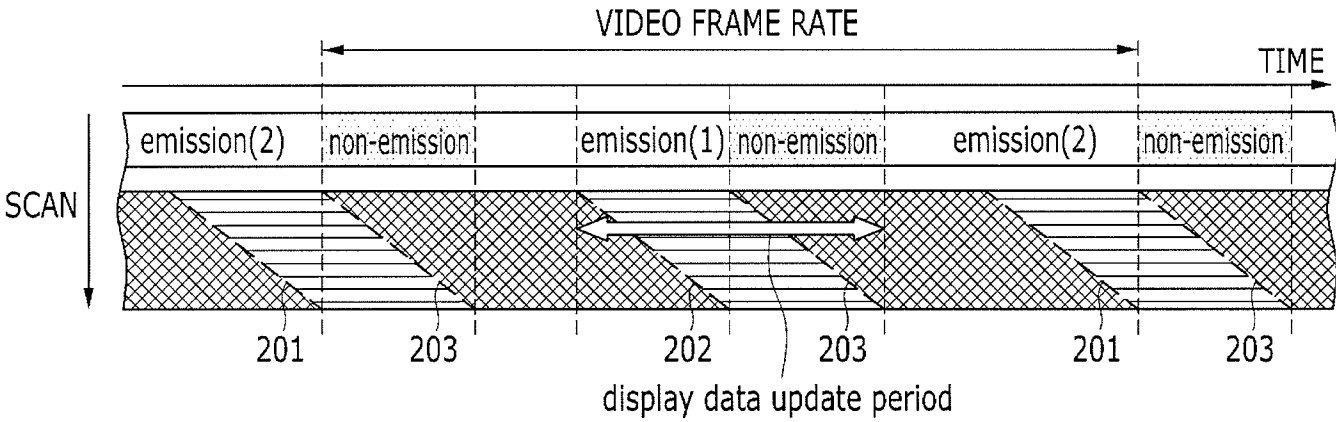
FIG. 9 is a view showing yet another example of the panel driving timing of the electro-optic device according to an exemplary embodiment.

FIG. 9 is a view showing yet another example of the panel driving timing of the electro-optic device 100 according to an exemplary embodiment. If the non-emission period is shorter than the emission period, as shown in FIG. 9, a maximum data write period can be secured by securing a maximum data update period of the pixel 130*a* and the pixel 130*b* with respect to the length of the non-emission period.

Although exemplary embodiments have been described with reference to the attached drawings, they are not limited to these embodiments. It is clear that those skilled in the art could conceive of various altered or modified examples within the scope of the technical idea set forth in the claims, and it is to be understood that such examples also naturally belong to the technical scope of the invention. For example, the foregoing embodiments have been described with respect to an AMOLED, however, the example embodiments are not limited thereto. In another example, the driving timing may be applied to a pixel circuit incorporating a characteristic disparity compensation circuit of a driving TFT applied when LTPS is used as a backplane of the panel.

DESCRIPTION OF SYMBOLS

| | |
|---|---|
| 100 electro-optic device | 110a, 110b, 110c driving TFT |
| 111a, 111b, 111c pixel switch | 112a, 112b, 112c light emission switch |
| 120a, 120b pixel circuit | 121a, 121b, 121c light emitting element |
| 122a, 122b, 122c capacitor | 130a, 130b pixel |
| 131 scan control circuit | 132 data signal control circuit |
| 133 control circuit | 140a, 140b, 140c scan line |
| 141 data signal line | 142 anode power line |
| 143 cathode power line | 144 light emission control signal line |
| 145 target pixel switching signal line | |

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An electro-optic device, comprising:

a plurality of pixels at intersections of a plurality of data lines and scan lines, the plurality of pixels including a plurality of first pixels and a plurality of second pixels, wherein:

the first pixels are in alternating columns, each of the first pixels including a first light emitting element and only one pixel circuit to cause the first light emitting element to emit light, and the second pixels are in alternating columns between the first pixels, each of the second pixels including a second light emitting element and at least two pixel circuits to cause the second light emitting element to emit light, wherein:

the first and second light emitting elements emit light for a predetermined period of an emission period of a frame and do not emit light during a non-emission period of the frame, a writing process on the first pixels is performed in the non-emission period, and a writing process on the second pixels is performed in the emission period.

2. The electro-optic device of claim 1, wherein the at least two pixel circuits on one side of the each of the second pixels are physically divided.

3. The electro-optic device of claim 2, wherein the divided pixel circuits are positioned at different parts of the second pixels, each of the different parts including only one pixel circuit.

4. The electro-optic device of claim 1, wherein the emission period and the non-emission period are repeated twice in 1 frame.

5. The electro-optic device of claim 1, wherein the emission period and the non-emission period have the same length.

6. The electro-optic device of claim 1, wherein the emission period and the non-emission period have different lengths.

7. The electro-optic device of claim 1, wherein:

the emission period includes a first emission period and a second emission period, which are divided by the non-emission period, the at least two pixel circuits include a first pixel circuit and a second pixel circuit, and the writing process on the second pixels includes a writing process on the first pixel circuit and a writing process on the second pixel circuit, wherein:

the writing process on the first pixel circuit is performed in the first emission period, and the writing process on the second pixel circuit is performed in the second emission period.

8. The electro-optic device of claim 1, wherein:

the emission period includes a first emission period and a second emission period, which are divided by the non-emission period, the at least two pixel circuits include a first pixel circuit and a second pixel circuit, the second light emitting element emits light by the first pixel circuit in the first emission period, and emits light by the second pixel circuit in the second emission period, and the first light emitting element emits light by the only one pixel circuit in the first emission period and the second emission period.

9. A driving method of an electro-optic device having a plurality of data lines, a plurality of scan lines, a plurality of pixels arranged at crossings of the data lines and the scan lines and including a plurality of first pixels and a plurality of second pixels, wherein each of the first pixels includes a first light emitting element, and each of the second pixels includes a second light emitting element, the method comprising:

configuring the first and second light emitting elements to emit light for a predetermined period of an emission period of a frame and not to emit light during a non-emission period of the frame, arranging the first pixels in alternating columns, each of the first pixels including only one pixel circuit for causing the first light emitting element to emit light;

arranging the second pixels in alternating columns, each of the second pixels being between two adjacent first pixels and including at least two pixel circuits for causing the second light emitting element to emit light;

performing a writing process on the second pixels in the emission period; and performing a writing process on the first pixels in the non-emission period.

10. The method of claim 9, wherein the emission period and the non-emission period are repeated twice in one frame.

11. The method of claim 9, wherein the emission period and the non-emission period have the same length.

12. The method of claim 9, wherein the emission period and the non-emission period have different lengths.

13. The method of claim 12, wherein, if the emission period is longer than the non-emission period, the writing process on the second pixels is performed only during the emission period.

14. The method of claim 9, wherein:

the emission period includes a first emission period and a second emission period, which are divided by the non-emission period, the at least two pixel circuits include a first pixel circuit and a second pixel circuit, and the writing process on the second pixels includes a writing process on the first pixel circuit and a writing process on the second pixel circuit, wherein:

the writing process on the first pixel circuit is performed in the first emission period, and the writing process on the second pixel circuit is performed in the second emission period.

15. The method of claim 9, wherein:

the emission period includes a first emission period and a second emission period, which are divided by the non-emission period, the at least two pixel circuits include a first pixel circuit and a second pixel circuit, the second light emitting element emits light by the first pixel circuit during the first emission period, and emits light by the second pixel circuit in the second emission period, and the first light emitting element emits light by the only one pixel circuit in the first emission period and the second emission period.

* * * * *